United States Patent [19]

Maurer

[11] 4,373,852

[45] Feb. 15, 1983

[54] QUICK COUPLING AND RELEASE MECHANISM FOR BUCKETS

[75] Inventor: Herman J. Maurer, Burlington, Iowa

[73] Assignee: J. I. Case Company, Racine, Wis.

[21] Appl. No.: 280,654

[22] Filed: Jul. 6, 1981

[51] Int. Cl.[3] ..... E02F 3/70

[52] U.S. Cl. ..... 414/723; 172/272

[58] Field of Search ..... 414/723, 724, 607; 37/117.5, 120, DIG. 3, DIG. 12; 172/272–274

[56] References Cited

U.S. PATENT DOCUMENTS

| | | | |
|---|---|---|---|
| 3,874,533 | 4/1975 | Montgomery et al. | 172/272 X |
| 3,934,738 | 1/1976 | Arnold | 414/723 |
| 4,225,283 | 9/1980 | Baker et al. | 414/723 |
| 4,345,872 | 8/1982 | Arnold | 414/723 X |

*Primary Examiner*—Robert J. Spar
*Assistant Examiner*—Donald W. Underwood
*Attorney, Agent, or Firm*—Cullen, Sloman, Cantor, Grauer, Scott & Rutherford

[57] ABSTRACT

A quick coupling and release mechanism for attaching a material handling bucket, blade, compactor, impact hammer, or other attachment to the free end of a scoop arm extending from a loader or backhoe. The quick coupler has a three-leg configuration, including a hub, a pair of spaced apart depending legs adapted to be pivotally connected to the end of a loader arm, and a third leg extending from the hub in a cantilevered fashion with a slotted end for selective engagement with a permanent mounting pin on the bucket. The conventional push-pull links operatively connected with the loader arm are pivotally connected at one end to the third leg of the quick coupler, and the hub of the quick coupler is attached to the bucket by a releasable bucket mounting pin, thereby completing the coupled connection between the bucket and loader scoop arm. A single operator can easily handle the entire coupling or uncoupling operation without special tools. Further, the quick coupler does not require a special bucket construction or the attachment of special parts to the bucket for its operability.

3 Claims, 5 Drawing Figures

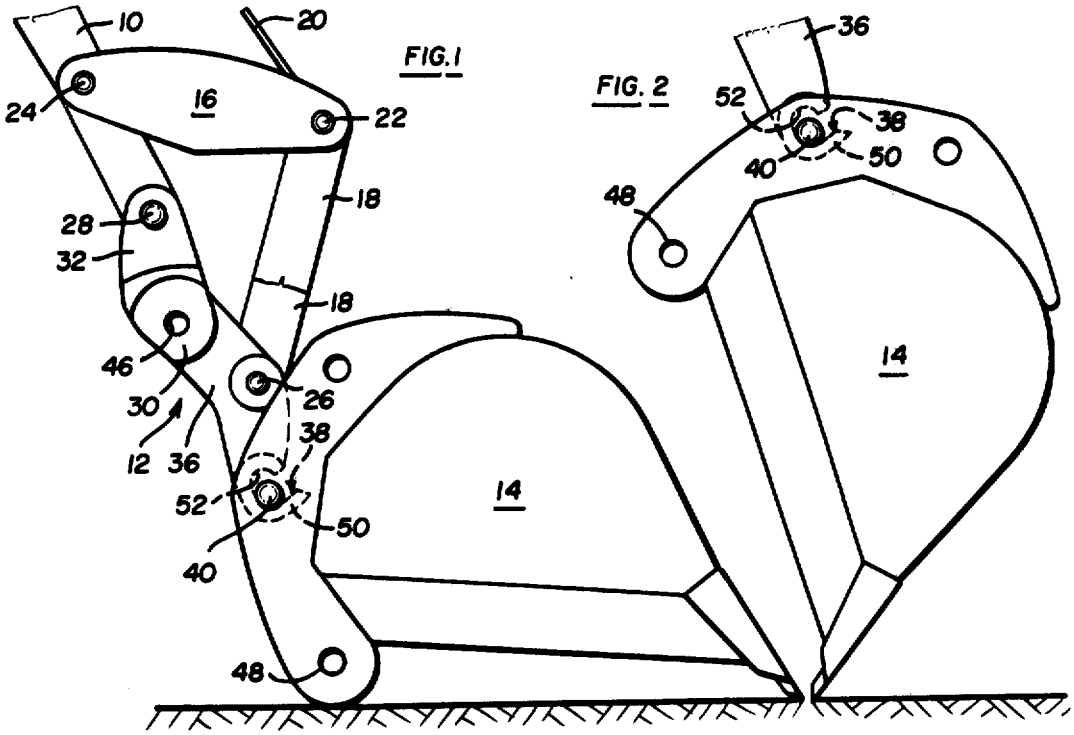
FIG. 1
FIG. 2
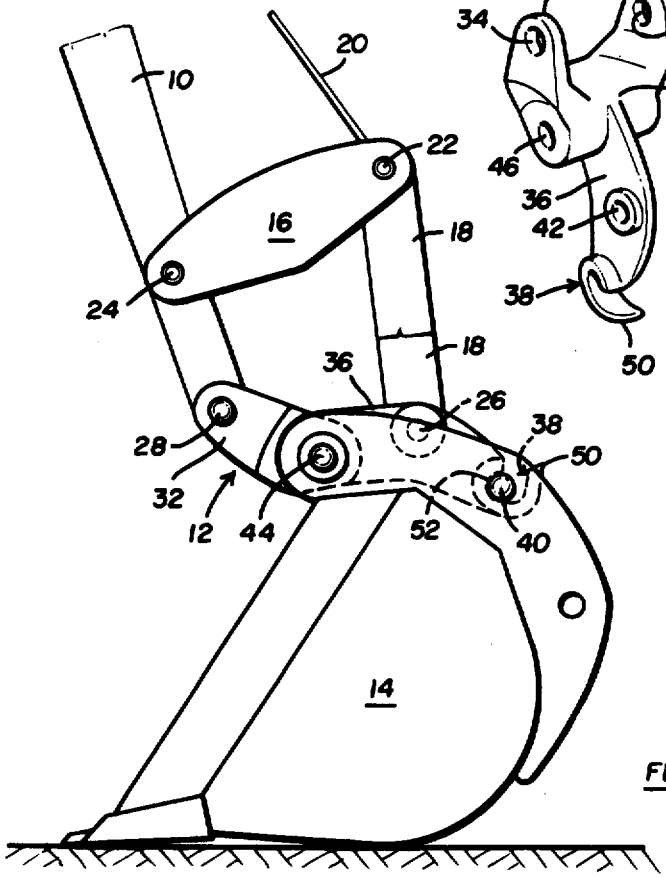
FIG. 3
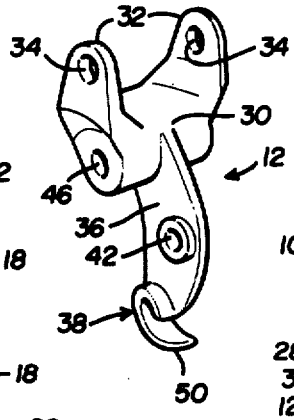
FIG. 5
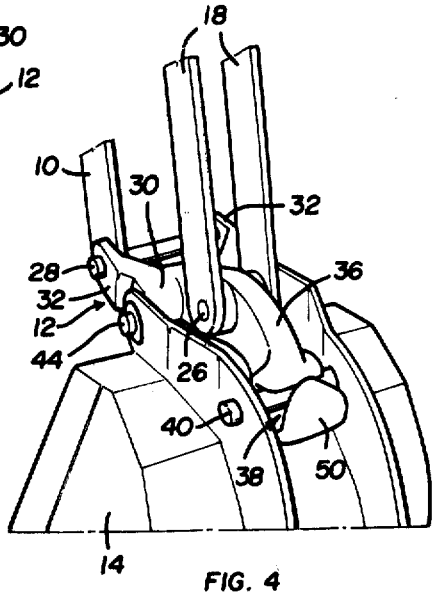
FIG. 4

QUICK COUPLING AND RELEASE MECHANISM FOR BUCKETS

BACKGROUND OF THE INVENTION

The present invention relates to an apparatus for attaching implements to the free end of a tractor loader boom and, more particularly, to an improved and simplified quick attachment and release device for attaching buckets or the like to a loader or backhoe scoop arm.

It is known to provide backhoes or similar types of earth-working machines with different sizes and types of material handling implements or buckets to perform numerous working operations. Changing from one bucket to another is a problem because of the time and labor expended in the changeover. The buckets are heavy and awkward to manipulate and many times special tools are required to make the changeover. It is an object of this invention to provide a quick-attaching and release mechanism for easily coupling and releasing different buckets to the same loader boom structure.

In prior art backhoes, the buckets are typically pinned to the actuating arms of the loader scoop arm during periods of use. The attachment of a bucket normally requires a two-man operation with one man on the tractor positioning the attaching points on the dipper stick adjacent to the attaching points on the bucket and a second man guiding and directing the bucket by prying and the like to make the final adjustments for connecting the dipper stick to the bucket. Since the buckets are heavy items, a great deal of time and effort is required to attach the bucket or release the bucket from the scoop arm for repairs to the bucket or the actuating arms.

Further, after a period of use, dirt and corrosion often render removal of the bucket from the loader arm quite difficult. Thus, the problems encountered by using bolts and nuts or pins as the attachment and release mechanisms for loader buckets has resulted in reduced flexibility in using a loader in connection with other buckets and undesirable features in performing maintenance on the bucket and loader.

The prior art semi-automatic devices for attaching and releasing implements on loaders have eliminated many of the problems associated with the use of bolts and nuts or pins. However, due to the design of such prior art devices, fatigue and fracture continue to be a problem, and dirt often causes the complex operative elements of the attachment and release devices to become jammed. Further, the latching devices are often activated from the vehicle's operator station which necessitates an additional operator action. Thus, several of the problems associated with manual attachment devices also exist when semi-automatic quick attachment and release devices of the prior art are utilized.

These disadvantages of present quick attaching mechanisms have resulted in the present quick coupling device for attaching a material handling implement or bucket to a loader's boom structure.

SUMMARY OF THE INVENTION

In accordance with the present invention, the improved attachment and release mechanism permits various buckets to be used with the same scoop arm, and it permits a bucket to be attached or released from the scoop arm in a minimum of time and with a minimum of effort.

The prior U.S. patents to Baker et al, No. 4,225,283, and Natzke et al (Serial No. 139,037), assigned to the assignee of the present invention, disclose quick coupling mechanisms that permit a bucket to be conveniently attached or released from the scoop arm. The present invention provides an improvement over those mechanisms by utilizing a simpler construction which is operable with one operator using a minimum amount of physical exertion.

It is an object of the present invention to provide a quick coupling bucket mounting mechanism which is pivotally connected to the end of a loader scoop arm for readily receiving various types and sizes of buckets. The quick coupling mechanism has a three-leg configuration including a hub, a pair of spaced apart depending legs adapted to be pivotally connected to the end of a loader arm, and a third leg extending from the hub in a cantilevered fashion with a slotted end for selective engagement with a permanent mounting pin on the bucket. The conventional push-pull links operatively connected with the loader arm are pivotally connected at one end to the third leg of the quick coupler, and the hub of the quick coupler is attached to the bucket by a releasable bucket mounting pin, thereby completing the coupled connection between the bucket and loader scoop arm.

The quick coupling mechanism is attachable to a bucket that is sitting up or to a bucket having its open side down. Initially, the operator maneuvers the quick coupling mechanism to capture the permanent mounting pin on the bucket within the slotted end of the coupler third leg. Next, the loader arm is raised to a position where the bucket hangs freely for swinging movement. Then, the push-pull links are operated to align the opening through the quick coupler hub with the attachment points on the bucket. Thereafter, the bucket is easily rocked by hand for any final adjustment since the bucket is in a balanced condition. A mounting pin having a handle is inserted through the aligned bucket attaching points and hub opening thereby connecting the bucket and loader scoop arm.

The bucket is uncoupled from the loader arm by going through the steps just described in reverse. First, the operator releases the pin through the hub of the quick coupler so that the bucket assumes a free hanging position. The loader arm is lowered to place the bucket on the ground and the push-pull links are actuated to pivot the quick coupler for releasing the slotted end on the coupler third leg from the permanent mounting pin on the bucket.

A further feature of the present invention resides in a tapered tongue on the slotted end of the quick coupler which is generally perpendicular to the longitudinal axis of the slotted end. The tongue provides the operator with a visual indicator for the end of coupler and initially supports the bucket by its permanent mounting pin until the quick coupler is rotated for seating the permanent bucket mounting pin within the slotted end of the coupler. The tonque is tapered to permit easy engagement with the mounting pin and to provide the operator with a point of reference for making the connection between the loader arm and bucket.

Thus, the present quick coupler mechanism provides several advantages over prior constructions. The coupler is compact, easy to manufacture, and reliable in operation in various environments. A single operator can easily handle the entire coupling or uncoupling operation without special tools. Further, the quick coupler does not require a special bucket construction or the attachment of special parts to the bucket for its operability.

Other advantages and meritorious features of the quick attachment and release construction of the present invention will be more fully understood from the following description of the preferred embodiment, the appended claims, and the drawings, a brief description of which follows.

BRIEF DESCRIPTION OF DRAWINGS

FIG. 1 is a side elevational view of a loader scoop arm and bucket partially connected to the scoop arm by the quick coupler and release device of the present invention.

FIG. 2 is a side elevational view of the bucket hanging freely for swinging movement during the attachment procedure.

FIG. 3 is a side elevational view of the loader scoop arm and bucket fully connected.

FIG. 4 is a perspective view of the coupled connection shown in FIG. 3.

FIG. 5 is a perspective view of the quick coupler and release device of the present invention.

DETAILED DESCRIPTION OF THE INVENTION

A tractor mounted backhoe having an extensible dipper stick 10 and quick coupling mechanism 12 according to the present invention is illustrated in FIGS. 1–5. The backhoe assembly includes a rearwardly projecting boom (not shown) to which is connected the dipper stick 10 in a conventional manner. A bucket assembly 14 is pivotally attached to the end of the dipper stick by the quick attachment and release device 12 of the present invention.

The bucket mounting linkage includes dipper stick links 16, push-pull links 18, and quick coupler 12 for readily attaching various types and sizes of buckets. Piston rod 20 of a hydraulically actuated cylinder (not shown) is attached at its extensible end to links 16 and 18 by pin 22. Extension and retraction of the hydraulic cylinder causes the coupled bucket assembly 14 to pivot toward and away from dipper stick 10 thereby permitting the backhoe bucket to dig or dump.

Links 16 are pivotally attached to dipper stick 10 by pin 24 and push-pull links 18 are pivotally attached to quick coupler 12 by pin 26. Thus, a four bar bucket mounting linkage is formed for coupling bucket 14 to scoop arm 10 including links 16 and 18, quick coupler 12, and that portion of dipper stick 10 between pin 24 and the releasable pin 28 that pivotally connects quick coupler 12 to the end of dipper stick 10.

In accordance with the present invention, the improved attachment and release mechanism 12 permits various buckets to be used with the same scoop arm, and it permits a bucket 14 to be attached or released from the scoop arm 10 in a minimum of time and with a minimum of effort.

The quick coupler 12 has a three-leg configuration including a hub 30, a pair of spaced-apart depending legs 32 having openings 34 for pivotal connection with pin 28, and a third leg 36 extending from hub 30 in a cantilevered fashion. Coupler 12 is pivotally attached to the end of scoop arm 10 by pin 28 that passes through openings 34 in depending legs 32. The third leg 36 that extends from hub 30 includes a slotted end portion 38 for selective engagement with a permanent mounting pin 40 on bucket 14. Push-pull links 18 are pivotally connected at one end to cantilevered leg 36 by a pin 26 that passes through opening 42 in leg 36. The hub 30 of quick coupler 12 is attached to bucket 14 by a releasable bucket mounting pin 44 that passes through opening 46 in hub 30 and through bucket attaching points 48, thereby completing the coupled connection between bucket 14 and loader scoop arm 10.

The quick coupling mechanism 12 is attachable to a bucket 14 that is sitting up, as illustrated in FIG. 3, or to a bucket 14 having its open side down, as illustrated in FIG. 1. Referring to FIG. 1, the operator initially maneuvers the quick coupling mechanism 12 to capture the permanent bucket mounting pin 40 within the slotted end 38 of cantilevered leg 36. Next, loader arm 10 is raised to a position, as illustrated in FIG. 2, where the bucket 14 hangs freely for swinging movement. Then, push-pull links 18 are operated to align the opening 46 through quick coupler hub 30 with the attachment points 48 on bucket 14. Thereafter, bucket 14 is easily rocked by hand for any final adjustment since it is in a balanced condition. A releasable mounting pin 44, which may have a handle thereon, is inserted through the aligned bucket attaching points 48 and hub opening 46 thereby completing the connection between bucket 14 and loader scoop arm 10 as illustrated in FIGS. 3 and 4.

Bucket 14 is uncoupled from loader arm 10 by going through the steps just described in reverse. First, the operator releases pin 44 so that the bucket 14 may assume a free hanging position as illustrated in FIG. 2. Loader arm 10 is then lowered to place the bucket on the ground, as illustrated in FIG. 1, and push-pull links 18 are actuated to pivot quick coupler 12 for releasing the slotted end 38 from the permanent mounting pin 40 on the bucket.

A further feature of the present invention resides in a tapered tongue portion 50 on the slotted end 38 of quick coupler 12 which is generally perpendicular to the longitudinal axis of slotted end 38. Tongue 50 provides the operator with a visual indicator for the end of coupler 12 and initially supports the bucket 14 by its permanent mounting pin 40, as illustrated in FIG. 2, until quick coupler 12 is rotated for seating permanent bucket mounting pin 40 within slotted groove 52. The tongue portion 50 is tapered to permit easy engagement with mounting pin 40 and to provide the operator with a point of reference for making the connection between the loader arm 10 and bucket 14.

Thus, the present quick coupler mechanism 12 provides several advantages over prior constructions. Coupler 12 is compact, easy to manufacture, and reliable in operation in various environments. A single operator can easily handle the entire coupling or uncoupling operation without special tools. Further, quick coupler 12 does not require a special bucket construction or the attachment of special parts to the bucket for its operability.

It will be apparent to those skilled in the art that the foregoing disclosure is exemplary in nature rather than limiting, the invention being limited only by the appended claims.

I claim:

1. A quick attachment and release mechanism for attaching a bucket to a loader scoop arm having extensible and retractable push-pull links operatively attached thereto, said mechanism comprising:

a quick coupler pivotally mounted to one end of said scoop arm for receiving various types and sizes of buckets, said quick coupler having a three leg configuration including a hub, a pair of spaced apart depending legs pivotally mounted to opposite sides o said scoop arm end, and a third leg extending from said hub in a cantilevered fashion, said third leg having a slotted end for selective engagement with a mounting pin on said bucket, said push-pull links pivotally connected at one end to said quick coupler third leg and said hub being pivotally attached to attaching points on said bucket by a releasable mounting pin.

2. The quick attachment and release mechansim as defined in claim 1 wherein said slotted end on said third leg includes a tapered tongue portion and a groove portion for holding said mounting pin on said bucket, said tongue portion being generally perpendicular to and spaced from the longitudinal axis of said pin holding groove portion, said quick coupler being initially positioned with said tapered tongue portion in engagement with said bucket mounting pin and later positioned with said pin holding groove portion in engagement with said bucket mounting pin.

3. A quick coupler pivotally mounted to one end of a loader arm for receiving various types and sizes of buckets, said quick coupler including a hub, a pair of spaced apart depending legs pivotally mounted to opposite sides of said loader arm end, a cantilevered leg extending from said hub and having a slotted end for engagement with a mounting pin on a bucket, said cantilevered leg pivotally attached to push-pull links that are operatively connected to said loader arm, said slotted end including a tapered tongue portion and groove portion for holding said mounting pin, said quick coupler being movable to a first position where said tongue portion engages said bucket mounting pin and supports said bucket for swinging movement, and said quick coupler being movable to a second position where said pin holding groove portion engages said bucket mounting pin and said hub being attached to said bucket by a releasable mounting pin.

* * * * *